United States Patent [19]

Brües

[11] 4,103,485

[45] Aug. 1, 1978

[54] ELASTIC WARP-KNIT FABRIC

[75] Inventor: Friedrich E. Brües, Hilden, Fed. Rep. of Germany

[73] Assignee: Gold-Zack Werke AG, Mettmann, Fed. Rep. of Germany

[21] Appl. No.: 718,618

[22] Filed: Aug. 30, 1976

[30] Foreign Application Priority Data

Sep. 1, 1975 [DE] Fed. Rep. of Germany ..... 2538776
Jul. 21, 1976 [DE] Fed. Rep. of Germany ..... 2632793

[51] Int. Cl.[2] ..... D04B 23/08
[52] U.S. Cl. ..... 66/192
[58] Field of Search ..... 66/190, 192, 193, 195

[56] References Cited

U.S. PATENT DOCUMENTS

| | | | |
|---|---|---|---|
| 2,149,031 | 2/1939 | Schionfeld | 66/192 |
| 2,149,032 | 2/1939 | Schonfeld | 66/192 |
| 3,077,758 | 2/1963 | Siciliano | 66/192 |
| 3,389,582 | 6/1968 | Alexander | 66/192 |
| 3,552,155 | 1/1971 | Hartung | 66/192 |
| 3,733,859 | 5/1973 | Wittmann | 66/193 |

FOREIGN PATENT DOCUMENTS

| | | | |
|---|---|---|---|
| 237,490 | 7/1962 | Australia | 66/192 |

*Primary Examiner*—Ronald Feldbaum
*Attorney, Agent, or Firm*—Michael J. Striker

[57] ABSTRACT

A warp-knit fabric comprises a multiplicity of longitudinally extending and relatively inelastic warp yarns each forming a longitudinally extending chain of loops in turn forming a plurality of longitudinally extending wales. A multiplicity of mainly transversely extending and relatively elastic first weft yarns are laid into the loops of the warp yarns over only one of the wales thereof. A multiplicity of mainly transversely extending and relatively elastic second weft yarns are each laid into the loops of the warp yarns over at least two of the wales thereof. More specifically these second weft yarns are laid in over two wales, then in the next succeeding course move back one wale, then in the next succeeding course move forward two wales so as to achieve an overall warp reach of three wales.

10 Claims, 5 Drawing Figures

R

ELASTIC WARP-KNIT FABRIC

BACKGROUND OF THE INVENTION

The present invention relates to a knit fabric. More particularly this invention concerns a warp-knit elastic fabric.

It is known to produce warp-knit fabrics having some elastic properties. Nonetheless such fabrics often are inadequately elastic in at least one direction. Typically they have good longitudinal or warpwise stretch, but limited transverse or weftwise stretch. It has been suggested to use a highly elastic laid-in weft yarn. Nonetheless such fabric often is inadequately elastic or, at least, pulls when stretched in the weft direction.

SUMMARY OF THE INVENTION

It is therefore an object of the present invention to provide an improved knit fabric.

Another object is the provision of an improved elastic warp-knit fabric.

Another object is to provide such an improved warp-knit fabric which is highly elastic in both the warp and weft directions and which is highly wear-resistant.

These objects are attained according to the present invention in a warp-knit fabric which is comprised of a multiplicity of longitudinally extending and relatively inelastic warp yarns each forming longitudinally extending succession of loops in turn forming a plurality of longitudinally extending wales. Laid into these loops is a multiplicity of mainly transversely extending and relatively elastic first weft yarns which are each laid in over a predetermined first number of wales. Another multiplicity of mainly transversely extending and relatively elastic second weft yarns are also laid into the loops over a predetermined second number of wales equal to at least twice the first number. The weft reach of the second weft filaments is therefore much greater than the weft reach of the first filaments.

According to this invention the first filaments are each laid in simply over one wale of the fabric. This therefore imparts to the fabric in the warp direction or lengthwise the elasticity of this weft filament.

The second weft filaments have a substantially greater weft reach, extending over at least two and preferably three wales. This imparts to the fabric in the weft direction the elasticity of these second weft filaments. The combined elasticity in both warp and weft directions therefore makes the fabric also highly elastic diagonally or on the bias so that a highly elastic fabric results. Nonetheless the relatively inelastic warp yarns impart to the fabric good wearing properties.

In accordance with a further feature of this invention the second weft filaments do not make their entire weft reach in a single course. Instead each weft filament extends a portion of the way across its weft reach in one course, then comes partway back in the next course, then goes the rest of the way across its weft reach in the next succeeding course. This method of effectively taking two steps forward, one step back, then two steps forward to cover the entire weft reach is advantageous in that it prevents these weft filaments from catching on the warp filaments and makes for very dense and snag-free fabric.

Thus, in accordance with more specific features of this invention the fabric has a pattern repeat of six courses. The second weft yarns are each laid in over two wales in one weft direction in the first course of each repeat, over one wale in the opposite direction in the second course of each repeat, over two wales in the one direction in the third course, over two wales in the opposite direction again in the fourth course, over one wale in the one direction in the fifth course, and over two wales in the opposite direction in the sixth course. Thus the second weft filaments have an overall weft reach of three wales. With such a pattern even when strongly stretched in the weft direction these second filaments can readily return to their original position. There are no in-between points which would cause the weft filaments to bunch up and would, therefore, hinder such weft stretching. Thus the filaments will not move relatively to one another even when strongly transversely stressed.

According to yet another feature of this invention the chains of loops formed by the warp filaments extend over three wales and are formed of open and closed loops. This allows the fabric to be given virtually any other type of properties desired, such as a particular pattern or surface effect.

The novel features which are considered as characteristic for the invention are set forth in particular in the appended claims. The invention itself, however, both as to its construction and its method of operation, together with additional objects and advantages thereof, will be best understood from the following description of a specific embodiment when read in connection with the accompanying drawing.

SPECIFIC DESCRIPTION OF A PREFERRED EMBODIMENT

Figures 1, 2, 3, 4:
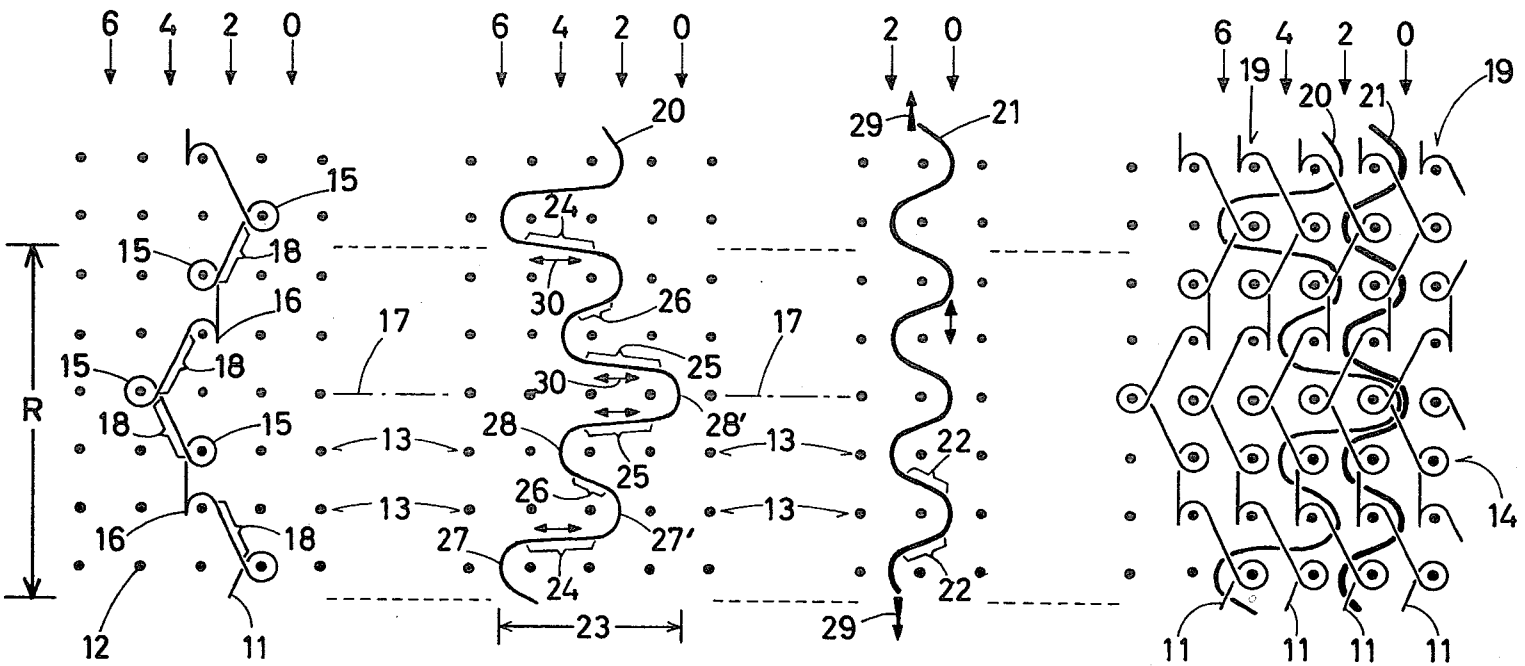
FIGS. 1, 2, and 3 are point-paper diagrams illustrating the patterns followed by the warp filaments, second weft filaments, and first weft filaments, respectively.
FIG. 4 is a point-paper diagram illustrating the finished fabric, only one of each of the weft filaments being shown.
Figure 5:
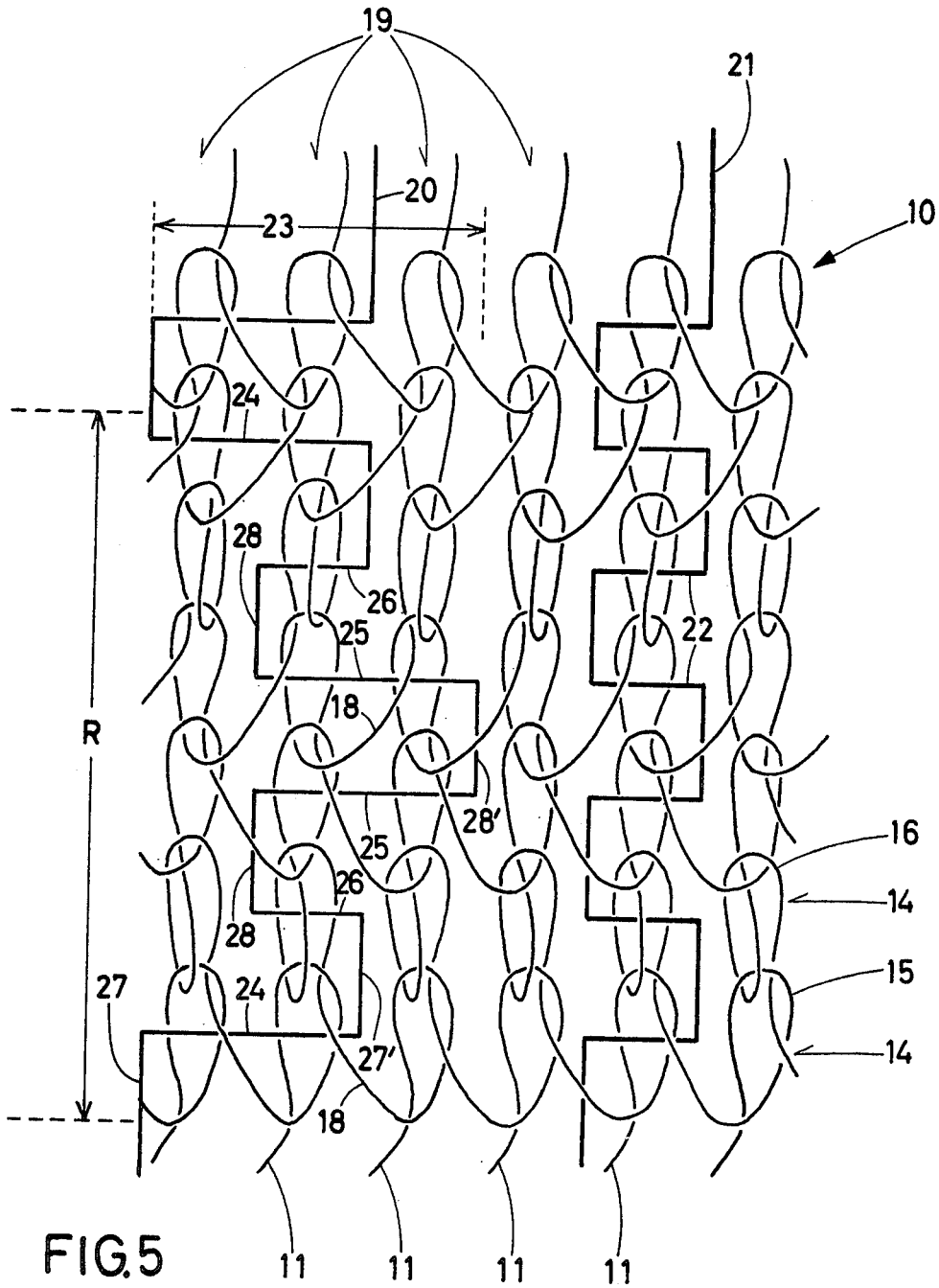
FIG. 5 is a largely diagrammatic view illustrating the finished knit goods in accordance with this invention, once again only one each of each of the weft filaments being shown.

FIG. 1 shows a point-paper diagram illustrating the pattern for one of the warp filaments 11 used to make the knit goods 10 shown in FIG. 5. A multiplicity of such warp yarns extend parallel to each other and all follow the same pattern indicated in FIG. 1. The yarns 11 are all of polyamide and are relatively inelastic.

In the chart of FIG. 1 the points 12 indicate the positions of the latch needles on the needlebar of a Raschel knitting machine. Each horizontal row 13 of these points forms one course 14 (FIG. 5) of warp-yarn loops. The warp filaments 11 each form a chain or succession of open loops 15 and closed loops 16. The pattern or figure is repeated every sixth cycle of the machine and is mirror symmetrical about a line 17.

As indicated in FIg. 1, with reference to the numerals 0, 2, 4, and 6 corresponding to guide-bar position, the filaments 11 are knitted in the following pattern:

2 - 0 / 2 - 4 / 4 - 2 / 4 - 6 / 4 - 2 / 2 - 4 //

In this notation the first number of each of the six pairs of numbers indicates the guide-bar position before the needle rises and the second number of each pair indicates the guide-bar position after the needle drops. It can be seen that the guide-bars form loops by moving while the needles are up for these warp filaments 11.

As mentioned above the pattern repeats itself every sixth cycle of the knitting machine. In between the warp filaments step through weft distances 18 twice across the goods in the weft direction so that each warp chain extends over three wales. Between the second and third, and fifth and sixth course of each pattern repeat R the warp filaments stay in the same wale, but between the first and second, and third and fourth they move one step in one direction, and between the fourth and fifth, and sixth and first of the next pattern repeat R they each move one step in the opposite direction. The second and fifth steps form open loops 16 and all of the other steps form closed loops 15.

First weft filaments 21 are laid into the goods 10 of FIG. 5 according to the pattern indicated in FIG. 3. These filaments 21 are not looped in as the filaments 11 are, but are simply laid in. More particularly each of the filaments 21 merely extends sinusoidally, without forming loops, back and forth over one course of the knit goods, taking a step 22 in one direction and then an opposite step 22 in the opposite direction. These filaments 21 are all of highly elastic material so as to impart to the goods a great elasticity in the direction of arrows 29. The filaments 21 are therefore laid in the following pattern:

2-2/0-0/2-2/0-0/2-2/0-0//.

Thus as the needles move up and down the guide-bars for the yarns 21 do not move at all, but merely shog back and forth the distance of one wale between reciprocations of the needles indicated by the points 12. Plainly the pattern of this filament 21 repeats itself every other course 14 and, therefore, also corresponds to the repeat R.

Finally, second weft filaments 20 are woven into the goods 10 of FIG. 5 as shown by the point-paper diagram of FIG. 2. It can be seen that these filaments 20 have a weft reach 23 which spreads over three wales, rather than the weft reach of filaments 21 which extends over only one wale. These weft filaments 20 are also highly elastic, like the filaments 21, and are laid in, without loop formation.

More particularly, the weft filaments 20 follow the following pattern:

6-6/2-2/4-4/0-0/4-4/2-2//.

Thus, once again, the guide-bars for the filaments 20 do not move as the needles go up and down, but merely shog back and forth between needle movements.

As shown in detail in FIG. 2 the weft filaments 20 have a pattern repeat R of six courses and move stepwise back and forth over their weft reach 23. Thus each weft filament 20 first takes a step 24 over two courses, then a step 26 back over one wale in the opposite direction. Then the weft filaments 20 each move forward over a step 25 covering two wales in one direction and then in an opposite step 25 in the opposite direction over two wales. A reverse step 26 in the opposite direction and final step 24 in the main direction over two steps in again made. These filaments 20 therefore each engage the fabric at bights 27 and 27' to each side of the step 24 and at bights 28 and 28' to each side of each step 25.

Since the filaments 20 extend over three wales in the weft direction they impart considerable elasticity to the fabric in the weft direction of arrow 30. This stretch combined with the stretch in the direction of arrow 29 makes the fabric perfectly stretchable in both warp and weft directions, and, indeed, even diagonally.

FIG. 4 shows the fabric, with only one of the weft filaments 20 and one of the weft filaments 21 being illustrated. The wales of this fabric are illustrated at 19 and the courses at 14. It can be seen how each time the warp filaments 11 do not move between successive cycles of the machine they first form an open loop 16 and then a closed loop 15. The goods have a repeat R extending over six courses which is also symmetrical about a line 17 through the foruth course.

The knit goods according to the present invention therefore exhibit high elasticity in both warp and weft directions. The use of polyamide relatively inelastic warp filaments give the goods high wearability. Furthermore, the laying-in of the second weft filaments 20 by steps prevent these filaments 20 from catching on the warp yarns and pulling.

Although the invention has been illustrated and described as emodied in knit goods having a very particular pattern for all of the yarns, it is not intended to limit the invention to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly consititute essential characteristics of the generic or specific aspects of this invention.

What is claimed as new and desired to be protected by Letters Patent is set forth in the appended claims:

1. A warp-knit fabric comprising:

a multiplicity of longitudinally extending and relatively inelastic warp yarns forming a multiplicity of respective longitudinally extending chains of loops in turn forming longitudinally extending wales and transversely extending courses;

a multiplicity of mainly transversely extending and relatively elastic first yarns each laid into said loops of said warp yarns over only a predetermined first number of said wales; and a multiplicity of mainly transversely extending and relatively elastic second weft yarns each laid into said loops of said warp yarns over a predetermined second number of said wales equal to at least twice said first number, each of said second weft yarns having a predetermined weft reach equal to at least three of said wales and extending over said weft reach in at least three of said courses in the first and third of which each second weft yarn extends in one weft direction over a third number equal to at least two of said wales and in the second of which each second weft yarn extends in the opposite weft direction over a fourth number smaller than said third number of said wales, said first and second weft yarns all extending in the same direction between adjacent courses.

2. The fabric defined in claim 1 wherein said first number is one and said second number is at least two.

3. The fabric defined in claim 2 wherein said second weft filaments extend a portion of the way across said first number of wales in one course, extend back in the opposite direction a part of said portion in the next course, and the rest of the way across said first number in the next succeeding course, then back in the opposite direction in three such stages, and so on.

4. The fabric defined in claim 2 wherein said yarns have a pattern repeat of six courses, said second weft yarn being laid in over two wales in one weft direction in the first course of each repeat, over one wale in the opposite direction in the second course of each repeat, over two wales in said one direction in the third course of each repeat, over two wales in said opposite direction in the fourth course of each repeat, over one wale in said one direction in the fifth course of each repeat, and over two wales in said opposite direction in the sixth course of each repeat.

5. The fabric defined in claim 2 wherein said chains of loops each extend over three wales.

6. The fabric defined in claim 2 wherein said warp yarns each form a chain of open and closed loops.

7. The warp-knit fabric defined in claim 1, wherein said second weft yarns are patterned 6-6/2-2/4-4/0-0/4-4/2-2.

8. The warp-knit fabric defined in claim 7, wherein said first weft yarns are patterned

2-/0-0/2-2/0-0/2-2/0-0.

9. The warp knit fabric defined in claim 8, wherein said warp yarns are patterned 2-0/2-4/4-2/4-6/4-2/2-4.

10. The warp-knit fabric defined in claim 1, wherein said third number is two and said fourth number is one.

* * * * *